US009105952B2

(12) United States Patent
Hoover et al.

(10) Patent No.: US 9,105,952 B2
(45) Date of Patent: Aug. 11, 2015

(54) WAVEGUIDE-CONFIGURATION ADAPTERS

(71) Applicant: Honeywell International Inc., Morristown, MN (US)

(72) Inventors: John C. Hoover, Femandina Beach, FL (US); Shawn David Rogers, Johns Creek, GA (US); John L. Beafore, Duluth, GA (US)

(73) Assignee: Honeywell International Inc., Morristown, NJ (US)

( * ) Notice: Subject to any disclaimer, the term of this patent is extended or adjusted under 35 U.S.C. 154(b) by 341 days.

(21) Appl. No.: 13/653,552

(22) Filed: Oct. 17, 2012

(65) Prior Publication Data

US 2014/0104014 A1 Apr. 17, 2014

(51) Int. Cl.

| | |
|---|---|
| ***H01P 5/12*** | (2006.01) |
| ***H01P 5/02*** | (2006.01) |
| ***H01Q 3/24*** | (2006.01) |
| ***H01P 5/08*** | (2006.01) |
| ***H01Q 19/06*** | (2006.01) |
| ***H01Q 5/47*** | (2015.01) |

(52) U.S. Cl.

CPC ..... *H01P 5/024* (2013.01); *H01P 5/082* (2013.01); *H01Q 3/24* (2013.01); *H01Q 5/47* (2015.01); *H01Q 19/06* (2013.01)

(58) Field of Classification Search

CPC ..... H01P 5/024; H01P 5/082; H01Q 5/47; H01Q 19/06; H01Q 3/24

USPC ..... 333/249, 239, 137, 135, 126, 129, 132

See application file for complete search history.

(56) References Cited

U.S. PATENT DOCUMENTS

| | | | | |
|---|---|---|---|---|
| 2,729,794 | A * | 1/1956 | Cohn | 333/21 A |
| 2,860,309 | A * | 11/1958 | Zaleski | 333/137 |
| 3,508,277 | A | 4/1970 | Ware et al. | |
| 3,922,621 | A | 11/1975 | Gruner | |
| 4,236,161 | A | 11/1980 | Ohm | |
| 4,415,901 | A | 11/1983 | Gans | |
| 5,442,329 | A | 8/1995 | Ghosh et al. | |
| 5,760,660 | A * | 6/1998 | Nagatsu et al. | 333/126 |

(Continued)

OTHER PUBLICATIONS

"'Magic Tee' Four Port Waveguide Coupler", Jul. 2012, p. 1 Publisher: Computer Simulation Technology.

(Continued)

*Primary Examiner* — Robert Pascal
*Assistant Examiner* — Kimberly Glenn
(74) *Attorney, Agent, or Firm* — Fogg & Powers LLC

(57) ABSTRACT

A waveguide-configuration adapter is provided. The waveguide-configuration adapter includes a horizontal waveguide and a vertical waveguide. The horizontal waveguide includes a first-interface port spanning a first X-Y plane and a first-coupling port spanning a Y-Z plane with a first-coupling-port width parallel to the y axis. The vertical waveguide includes a second-interface port spanning a second X-Y plane and a second-coupling port spanning a third X-Y plane with a second-coupling-port width parallel to the x axis. When an E-field is input at the first/second coupling port in the plane of the first/second coupling port, respectively, and oriented perpendicular to the first/second coupling-port width, respectively, the E-field is output from the second/first coupling port, respectively, in the plane of second/first coupling port, respectively, and oriented perpendicular to the second/first coupling-port width, respectively.

19 Claims, 9 Drawing Sheets

(56) References Cited

U.S. PATENT DOCUMENTS

| | | | | |
|---|---|---|---|---|
| 6,225,875 | B1 | 5/2001 | Kich | |
| 6,724,277 | B2 | 4/2004 | Holden et al. | |
| 6,756,861 | B2 * | 6/2004 | Rosenberg et al. | 333/125 |
| 6,879,221 | B2 * | 4/2005 | Beis et al. | 333/21 A |
| 7,656,359 | B2 | 2/2010 | Haziza | |
| 2004/0246062 | A1 | 12/2004 | Asao et al. | |
| 2008/0238579 | A1 | 10/2008 | Okano | |
| 2009/0309674 | A1 | 12/2009 | Girard et al. | |
| 2012/0032867 | A1 | 2/2012 | Fonseca | |
| 2014/0104017 | A1 | 4/2014 | Hoover et al. | |

OTHER PUBLICATIONS

European Patent Office, "Office Action from EP Application No. 13179012.3 mailed Sep. 5, 2014", "from Foreign Counterpart of U.S. Appl. No. 13/653,552", Sep. 5, 2014, pp. 1-7, Published in: EP.

European Patent Office, "European Search Report from EP Application No. 13179012.3 mailed Aug. 13, 2014", "from Foreign Counterpart of U.S. Appl. No. 13/653,552", Aug. 13, 2014, pp. 1-4, Published in: EP.

* cited by examiner

WAVEGUIDE-CONFIGURATION ADAPTERS

This invention was made with Government support under Contract No. F33657-02-D-0009 awarded by F-22, U.S. Air Force. The Government has certain rights in the invention.

BACKGROUND

It is important that individual radiating elements in antenna arrays are closely spaced to prevent grating lobes in the antenna pattern. Ideally, the element spacing should be held to less than a half wavelength of the electro-magnetic (EM) wave in order to completely suppress these lobes, although in most cases slightly greater spacing is acceptable. Achieving this close spacing is difficult in waveguide feed systems where the waveguide has a minimum half wavelength width. In dual band antenna systems, the two feed systems must be designed to avoid mechanical interference with each other.

In the dual band waveguide systems, one band is typically brought in axially to the dual band radiating element while the other band is brought in from the side. The side-feed traditionally requires both an H-plane bend followed by an E-plane bend. The physical structure of H-plane bends and E-plane bends makes it is difficult to achieve close element spacing in dual band waveguide systems.

SUMMARY

A waveguide-configuration adapter is provided. The waveguide-configuration adapter includes a horizontal waveguide and a vertical waveguide. The horizontal waveguide includes a first-interface port spanning a first X-Y plane and a first-coupling port spanning a Y-Z plane. The first-coupling port has a first-coupling-port width parallel to the y axis. The vertical waveguide includes a second-interface port spanning a second X-Y plane and a second-coupling port spanning a third X-Y plane. The second-coupling port has a second-coupling-port width parallel to the x axis. The second-interface port is juxtaposed to the first-interface port. When an E-field is input at the first-coupling port in the plane of the first-coupling port and oriented perpendicular to the first-coupling-port width, the E-field is output from the second-coupling port in the plane of second-coupling port and oriented perpendicular to the second-coupling-port width. When an E-field is input at the second-coupling port in the plane of the second-coupling port and oriented perpendicular to the second-coupling-port width, the E-field is output from the first-coupling port in the plane of first-coupling port and oriented perpendicular to the first-coupling-port width.

DRAWINGS

In accordance with common practice, the various described features are not drawn to scale but are drawn to emphasize features relevant to the present invention. Like reference characters denote like elements throughout figures and text.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that mechanical changes may be made without departing from the scope of the present invention. The following detailed description is, therefore, not to be taken in a limiting sense.

The waveguide-configuration adapter configuration described herein bends both an H-plane and an E-plane by 90 degrees without using a prior art E-plane bend or H-plane bend, such as those described below with reference to FIGS. 2A and 2B. Specifically, the waveguide-configuration adapters described herein functionally provide a 90 degree rotation of the E-field vector in the E-plane and a 90 degree twist of the E-plane. The E-plane is the plane spanned by the E-field vector (E) and the Poynting vector (S) of the EM wave, where $S=E\times H$. The 90 degree rotation of the E-field vector within the E-plane is referred to herein as an "E-plane bend". The H-plane is the plane spanned by the H-field vector (H) and the Poynting vector (S) of the EM wave. The 90 degree rotation of the H-field vector within the H-plane is referred to herein as an "H-plane bend".

Embodiments of the waveguide-configuration adapter described herein provide a solution to the problem described above. The waveguide-configuration adapters provide a compact connection of an EM radiation source to a coaxial waveguide in order to couple EM fields to the coaxial waveguide. The width of the waveguide-configuration adapter is within in a width that does not exceed the nominal width of a coaxial waveguide. A nominal width of a coaxial waveguide is a standard coaxial waveguide width for a given frequency band. Thus, the waveguide-configuration adapter does not inhibit the coupling of EM fields from the beam forming network behind an antenna array to the axial component of the coaxial waveguide. Since the waveguide-configuration adapters are compact, a plurality of the waveguide-configuration adapters can be implemented in a closely packed configuration while feeding both a first EM radiation source and a second EM radiation source (at a second frequency for the axial feed of the coaxial waveguide) to the coaxial waveguide. The coaxial waveguide is either a dual band antenna or used to feed a dual band antenna. When a plurality of waveguide-configuration adapters are used to side feed of the coaxial cable, the close element spacing provides an antenna that emits a beam having reduced side lobes.

Figure 1A:
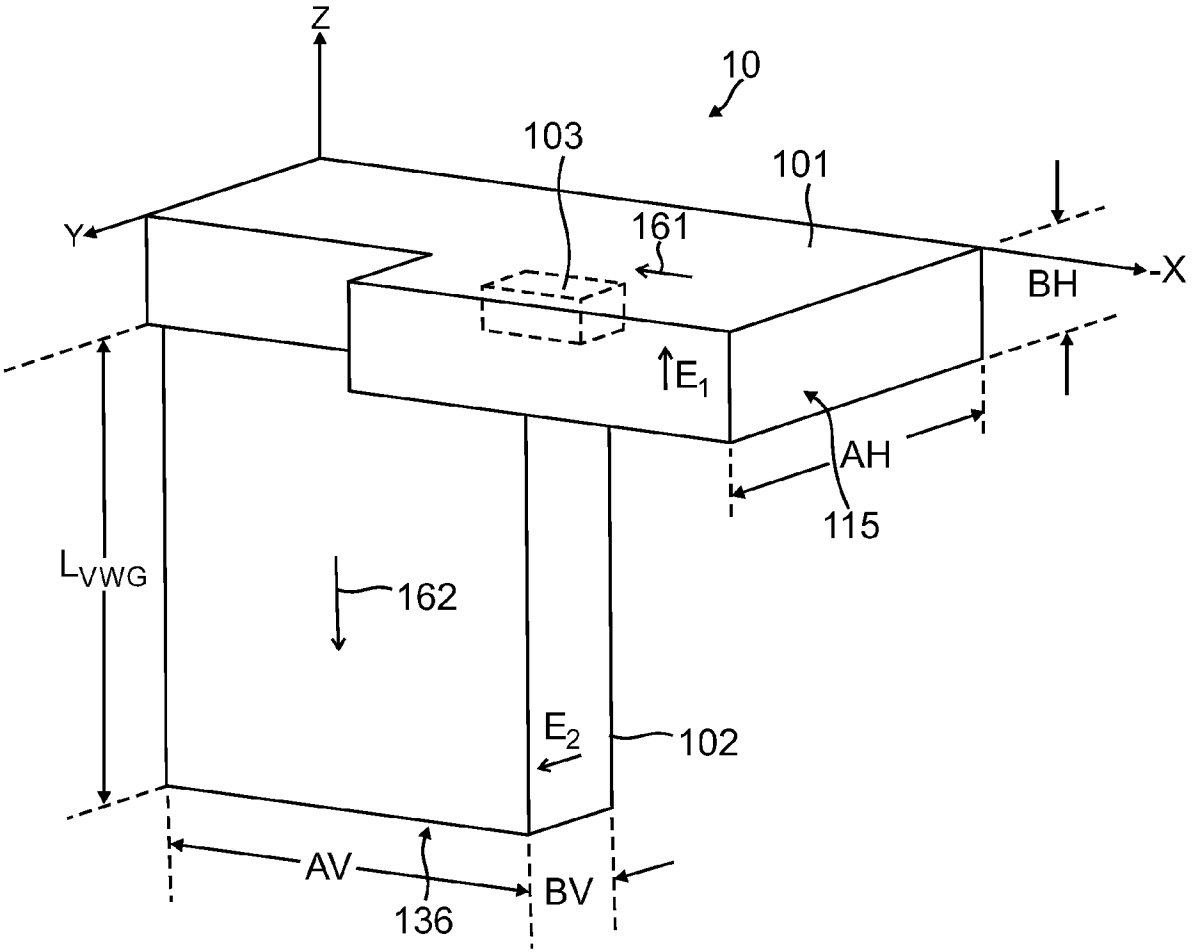
FIG. 1A is an oblique view of one embodiment of a waveguide-configuration adapter in accordance with the present invention.
Figure 1B:
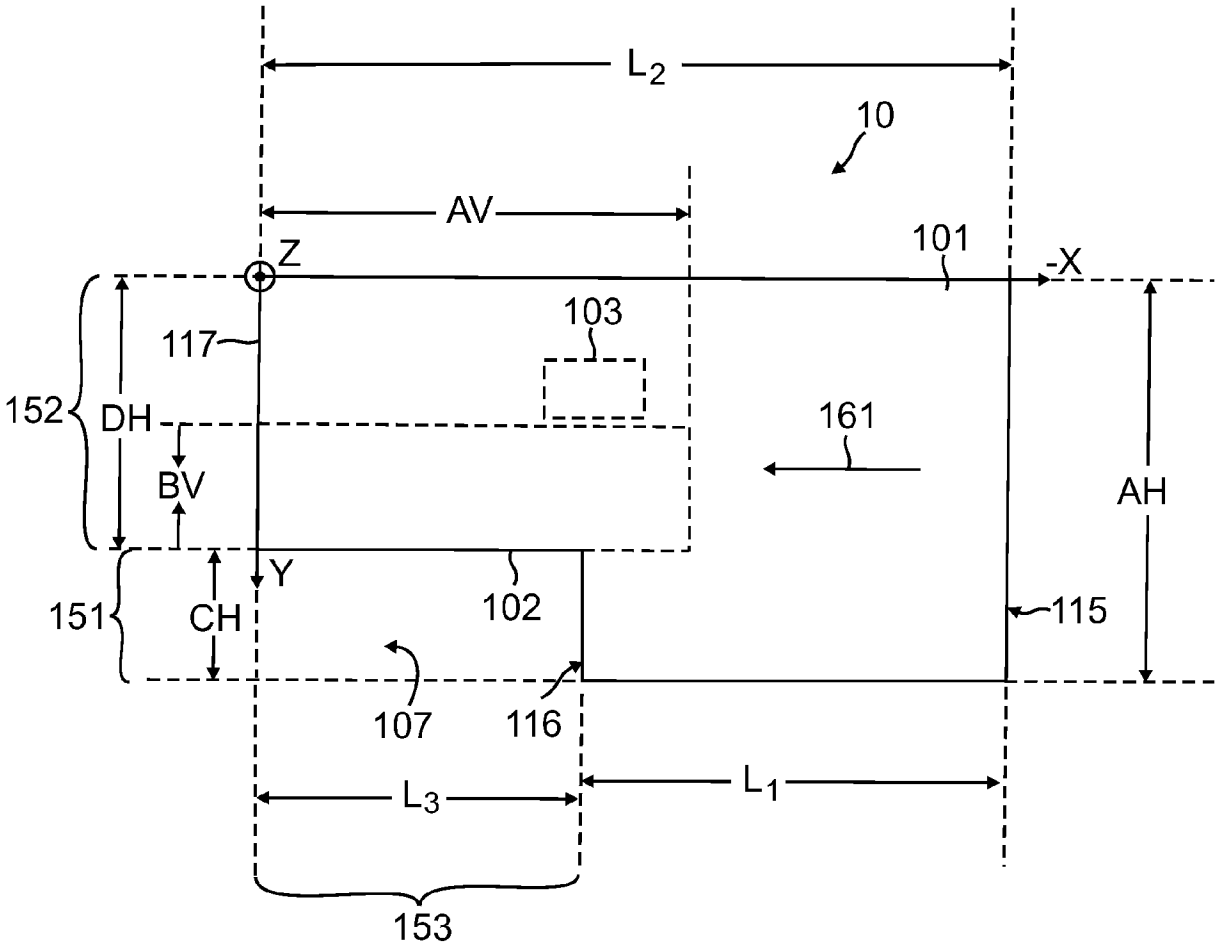
FIG. 1B is a top view of the waveguide-configuration adapter of FIG. 1A.
Figure 3A:
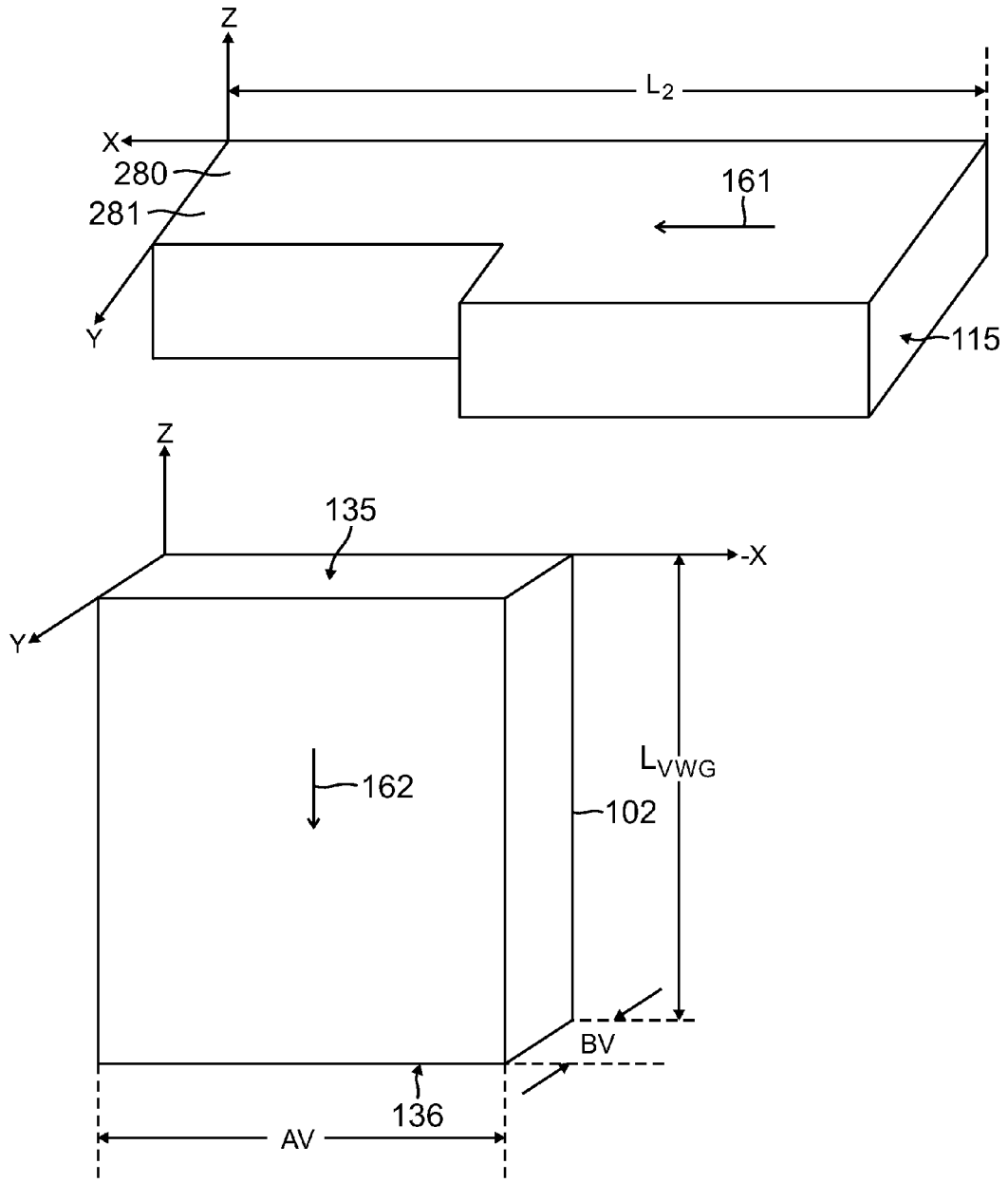
FIGS. 3A-3C are various views of the components of the waveguide-configuration adapter of FIGS. 1A and 1B.
Figure 3B:
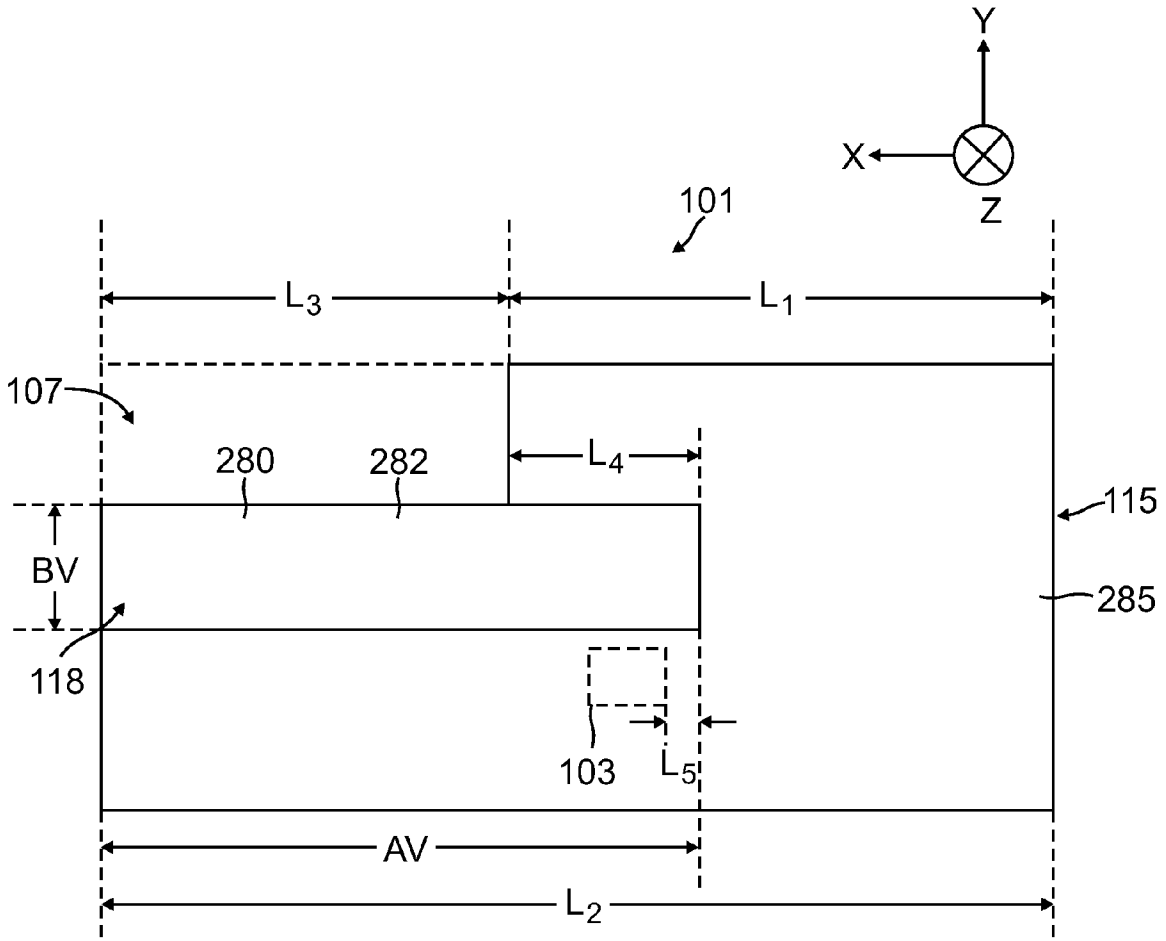
Figure 3C:
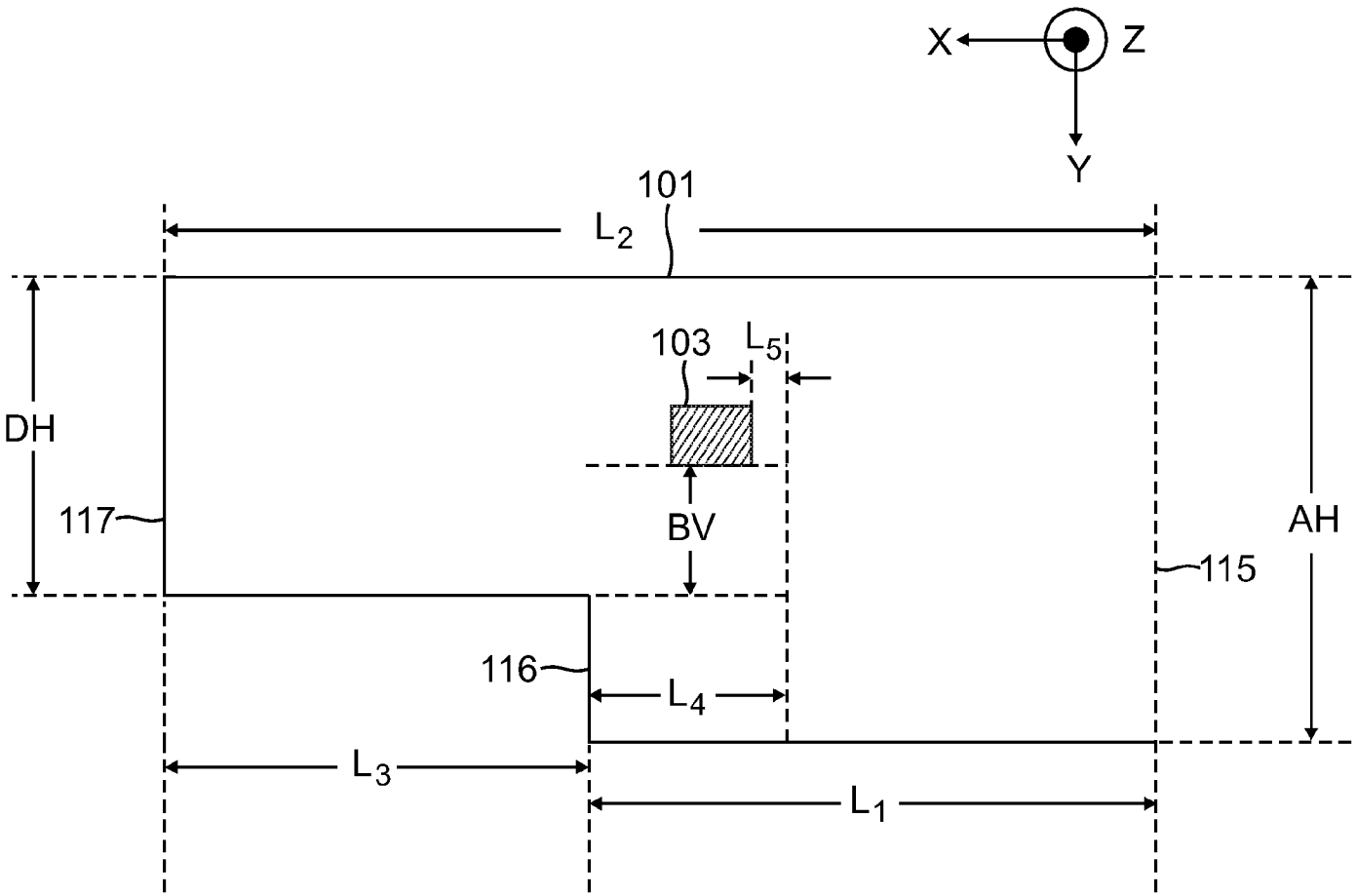

FIG. 1A is an oblique view of one embodiment of a waveguide-configuration adapter 10 in accordance with the present invention. FIG. 1B is a top view of the waveguide-configuration adapter 10 of FIG. 1A. FIGS. 3A-3C are various views of the components of the waveguide-configuration adapter 10 of FIGS. 1A-1B. The waveguide-configuration adapter 10 includes a horizontal waveguide 101, a vertical waveguide 102, and an adaptor matching element 103. The waveguide-configuration adapter 10 is designed for a particular frequency, bands of frequencies, polarization, or polarization and frequency. In one implementation of this embodiment, the horizontal waveguide 101 is a chamfered horizontal waveguide 101.

The horizontal waveguide 101 includes a first-coupling port 115 and a first-interface port 118 (FIG. 3B). The first-interface port 118 spans a first X-Y plane. The first-coupling port 115 spans a first Y-Z plane and has a first-coupling-port width AH parallel to the y axis. The "first-coupling-port width AH" is also referred to herein as "broad wall AH" of the horizontal waveguide 101. The adaptor matching element 103 (shown as a dashed box) is positioned in the horizontal waveguide 101. The position of the adaptor matching element 103 depends on the relative orientation of the horizontal waveguide 101 and a vertical waveguide 102 with reference to each other and in some embodiments is not required.

FIG. 3A shows an oblique view of the horizontal waveguide 101 and the vertical waveguide 102 offset from each other in order to clearly show the second-interface port 135 of the vertical waveguide 102. The vertical waveguide 102 includes a second-coupling port 136 and a second-interface port 135. The second-interface port 135 spans a second X-Y plane. The second-interface port 135 is juxtaposed to the first-interface port 118 so that the second X-Y plane is flush with the first X-Y plane. The second-interface port 135 has a height dimension of BV parallel to the y axis and a width dimension of AV parallel to the x axis.

The second-coupling port 136 spans a third X-Y plane. The second-coupling port 136 opposes the second-interface port 135 and has the same dimensions as the second-interface port 135. The width dimension of AV parallel to the x axis is referred to herein as the "second-coupling-port width" or the "broad wall" of the vertical waveguide 102. The third X-Y plane is offset from the second X-Y plane by the vertical-waveguide length $L_{VWG}$. Thus, the vertical waveguide 102 has a vertical-waveguide length $L_{VWG}$ extending parallel to the z axis.

When an E-field (shown as the arrow with the label "$E_1$") is input at the first-coupling port 115 in the Y-Z plane of the first-coupling port 115 and is oriented perpendicular to the first-coupling-port width AH (i.e., oscillating in the z direction), the E-field (shown as the arrow with the label "$E_2$") is output from the second-coupling port 136 in the X-Y plane of second-coupling port 136 and is oriented perpendicular to the second-coupling-port width AV (i.e., oscillating in the y direction). In this manner, the waveguide-configuration adapter 10 functionally provides an E-plane bend and a 90 degree twist of the E-plane.

An EM wave propagating along a first propagation path represented generally at 161 in the horizontal waveguide 101 is directed through a 90 degree bend so that the EM wave is directed to propagate along a second propagation path represented generally at 162 in the vertical waveguide 102. The second propagation path 162 is orthogonal to the first propagation path 161. It is to be understood that the arrows 161 and 162, indicative of the path of propagation of EM wave, are vectors aligned in the general direction of the Poynting vector (S=E×H) of the EM wave propagating in the horizontal waveguide 101 and the vertical waveguide 102, respectively. Any variation in the direction of propagation of various modes of the EM fields is averaged out so that arrows 161 and 162 show the effective overall path of propagation.

Since the waveguide-configuration adapter 10 is bidirectional, when an E-field $E_2$ is input at the second-coupling port 136 in the X-Y plane of the second-coupling port 136 and is oriented perpendicular to the second-coupling-port width AV, the E-field $E_1$ is output from the first-coupling port 115 in the first Y-Z plane of first-coupling port 115 and is oriented perpendicular to the first-coupling-port width AH. The EM wave to be bent 90 degrees and twisted 90 degrees by the waveguide-configuration adapter 10 is input into the first-coupling port 115 or the second-coupling port 136. The following description is based on coupling from the EM fields from the horizontal waveguide 101 to the vertical waveguide 102. However, the waveguide-configuration adapter 10 is operable to couple EM fields from the vertical waveguide 102 to the horizontal waveguide 101, and to a side feed of a coax cable (also referred to herein as a coaxial waveguide) as is understandable to one skilled in the art upon reading and understanding this document.

The horizontal waveguide 101 includes a first-opposing face 116 (FIG. 1B) in a second Y-Z plane that is parallel to the first Y-Z plane and offset from the first Y-Z plane by a first length $L_1$ parallel to the x axis. The horizontal waveguide 101 includes a second-opposing face 117 in a third Y-Z plane that is parallel to the first Y-Z plane and offset from the first Y-Z plane by a second length $L_2$ parallel to the x axis. The second length $L_2$ is greater than the first length $L_1$ by a third length $L_3$. Thus, the horizontal waveguide is notched by a notched region represented generally at 107 that has a length $L_3$ parallel to the x axis, a width equal to the width CH (FIG. 1B) of the first-opposing face 116, and a height BH (FIG. 1A) of the first-opposing face 116.

If the notched region 107 was not part of the horizontal waveguide 101, then the resultant horizontal waveguide would be a rectangular prism. As defined herein, a "rectangular prism" is a three-dimensional object that has six faces that are rectangles. The term "rectangular prism", as used herein, does not indicate a solid object but indicates an outer shape, which may have one or more open surfaces or partially open surfaces.

Because the horizontal waveguide 101 includes the notched region 107, the horizontal waveguide 101 has an outer shape of two conjoined, rectangular prisms in which one face (first-coupling port 115) is open and another face (a bottom face 285 shown in FIG. 3B) has an opening in a portion of the face. Specifically, the horizontal waveguide 101 has an outer shape of a first rectangular prism represented generally at 151 (FIG. 1B) conjoined with a second rectangular prism represented generally at 152 (FIG. 1B). The first rectangular prism 151 includes the first-opposing face 116 and has a length equal to the first length $L_1$. The second rectangular prism 152 includes the second-opposing face 117 and has a length equal to the second length $L_2$. The first rectangular prism 151 and the second rectangular prism 152 have open faces that together form the first-coupling port 115 that spans the first Y-Z plane. The portion of the second rectangular prism 152 that extends beyond the first rectangular prism 151 is adjacent to the notched region 107.

The vertical waveguide 102 is a rectangular prism with open opposing faces 135 and 136.

Figure 2A:
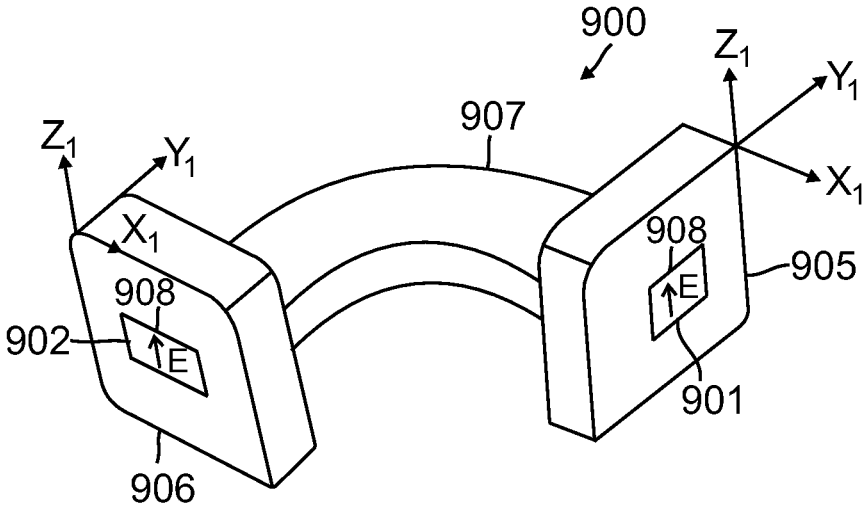
PRIOR ART FIG. 2A
FIG. 2A is an oblique view of a prior art H-plane bend.

FIG. 2A is an oblique view of a prior art H-plane bend 900. The "H-plane bend 900" is also referred to herein as an "H-bend 900". The H-plane of the H-bend 900 is spanned by the $X_1$-$Y_1$ plane. As shown in FIG. 2A, the E-field (show as the vector labeled "E") propagates from the first slot 901 on the first face 905 of the H-bend 900 to the second slot 902 of the second face 906 of the H-bend 900. The E-field (E) is perpendicular to the broad wall 908 of the bend-section 907 of the H-bend 900. The H-bend 900 rotates the H vector (that is perpendicular to the E vector and in the $X_1$-$Y_1$ plane) by 90 degrees (from the $y_1$ axis at the first slot 901 to the $x_1$ axis at the second slot 902) within the H-plane ($X_1$-$Y_1$ plane).

Figure 2B:
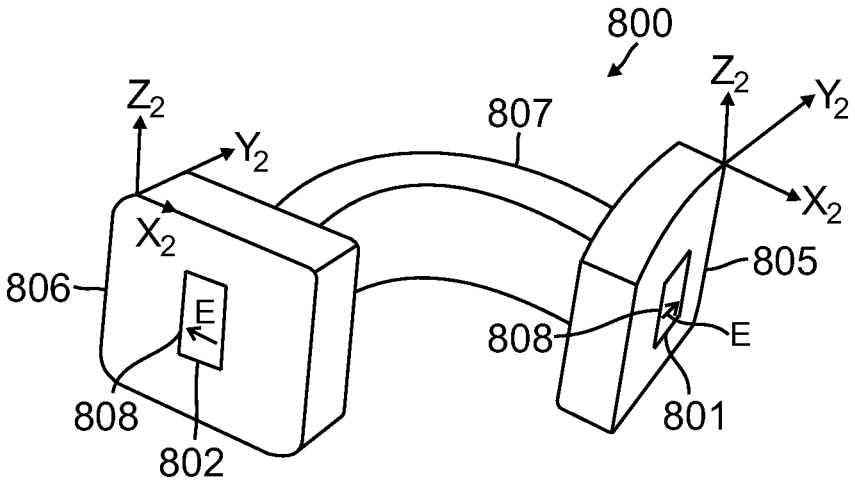
PRIOR ART FIG. 2B
FIG. 2B is an oblique view of a prior art E-plane bend.

FIG. 2B is an oblique view of a prior art E-plane bend 800. The "E-plane bend 800" is also referred to herein as an "E-bend 800". The E-plane of the E-bend 800 is spanned by the $X_2$-$Y_2$ plane. As shown in FIG. 2B, the E-field propagates from the first slot 801 on the first face 805 of the E-bend 800 to the second slot 802 of the second face 806 of the E-bend 800. The E-field (E) is perpendicular to the broad wall 808 of the bend-section 807 of the E-bend 800. The E-bend 800 rotates the E-field vector by 90 degrees (from the $y_2$ axis at the first slot 801 to the $x_2$ axis at the second slot 802) within the E-plane ($X_2$-$Y_2$ plane).

Neither the prior art H-bend 900 nor the prior art E-bend 800 provide an E-plane bend and a 90 degree twist of the E-plane.

The waveguide-configuration adapter 10 provides the functionality of an H-plane bend (e.g., the H-plane bend 900) followed by (attached to) an E-plane bend (e.g., the E-plane bend 800) without the large size of an H-plane bend attached to an E-plane bend. For the E-field input to the first face 905 of the H-bend 900 to be bent and twisted 90 degrees, the first slot 801 on the first face 805 of the E-bend 800 is aligned in juxtaposition with second slot 902 of the second face 906 of the H-bend 900. Specifically, the length 808 (broad wall 808) of the first slot 801 on the first face 805 of the E-bend 800 is aligned with the length 908 (broad wall 908) of the second slot 902 of the second face 906 of the H-bend 900. This configuration of H-bend 900/E-bend 800 components is bulky and does not provide a side feed of the coaxial cable used to feed the dual band antenna while allowing the close element spacing. The wide spacing between neighboring H-bend 900/E-bend 800 components requires wide spacing of individual radiating elements in antenna arrays which produce antenna patterns with large side lobes.

As shown and described herein, waveguide-configuration adapter 10 provides the function of an H-plane bend followed by an E-plane bend to couple EM fields to the side feed (i.e., the annular region of the coaxial waveguide), while staying within the nominal width of the input waveguide.

A top face 280 of the horizontal waveguide 101 is shown spanning the X-Y plane in FIG. 3A. The outside surface 281 of the top face 280 is visible in FIG. 3A. FIG. 3B shows a bottom view of the horizontal waveguide 101 in which the first-interface port 118 in a bottom face 285 of the horizontal waveguide 101 is visible. The bottom face 285 of the horizontal waveguide 101 is shown spanning the X-Y plane in FIG. 3B. An inside surface 282 of the top face 280 of the horizontal waveguide 101 is visible through the first-interface port 118 in FIG. 3B. The first-interface port 118 spans the first X-Y plane as described above with reference to FIGS. 1A and 1B. The first-interface port 118 has a dimension of BV parallel to the y axis and a dimension of AV parallel to the y axis. Thus, the second-interface port 135 (FIG. 3A) and the first-interface port 118 (FIG. 3B) have the same (or approximately the same) dimensions. When the waveguide-configuration adapter 10 is operable, the first-interface port 118 and the second-interface port 135 are juxtaposed adjacent to each other so that the first-interface port 118 and the second-interface port 135 overlap each other. The first propagation path 161 of the EM wave is directed through a 90 degree bend from the horizontal waveguide 101 via the juxtaposed first-interface port 118 and the second-interface port 135 to the vertical waveguide 102.

The adaptor matching element 103 is shown in FIG. 3B as a dashed box to indicate an exemplary position of the adaptor matching element 103 on the bottom face 285.

FIG. 3C shows a cross-sectional view of the horizontal waveguide 101 and the adaptor matching element 103 in an X-Y plane. As shown in FIG. 1A, the adaptor matching element 103 is positioned on an inner surface (not visible) of the bottom face 285 of the horizontal waveguide 101. The adaptor matching element 103 is shown as a rectangular block although other shapes are possible. The position and the dimensions of the adaptor matching element 103 are selected to provide an impedance matching for the EM fields being coupled from the horizontal waveguide 101 via the first-interface port 118 and the second-interface port 135 to the vertical waveguide 102.

As shown in FIG. 3C, the position of the adaptor matching element 103 on the bottom face 285 of the horizontal waveguide 101 is adjacent to the first-interface port 118. In one implementation of this embodiment, the adaptor matching element 103 is positioned on the bottom face 285 in a region closer to the first-coupling port 115. In another implementation of this embodiment, the adaptor matching element 103 is positioned on the bottom face 285 further away from the first-interface port 118 than shown in FIGS. 3B and 3C. The precise position of the adaptor matching element 103 on the bottom face 285 of the horizontal waveguide 101 with reference to the first-interface port 118 is selected based on: the frequency of the coupled EM wave; dimensions of the horizontal waveguide 101; dimensions of the vertical waveguide 102; dimensions of the first-interface port 118; and dimensions of the second-interface port 135. In one implementation of this embodiment, the EM fields are in the radio frequency spectrum. In another implementation of this embodiment, the first frequency band of the EM wave directed through the waveguide-configuration adapter 10 is within the range of 20-30 GHz.

The waveguide-configuration adapter 10 is designed to bend (i.e., direct through a 90 degree propagation path change) EM waves from the horizontal waveguide 101 into the vertical waveguide 102 via the juxtaposed first-interface port 118 and second-interface port 135 with little or no loss or attention of the EM fields. The size and shape of the horizontal waveguide 101, the size and shape of the vertical waveguide 102, the dimensions of the first-interface port 118 in the horizontal waveguide 101, the dimensions of the second-interface port 135 in the vertical waveguide 102, the shape of the adaptor matching element 103, and the position of the adaptor matching element 103 on the inner surface of the bottom face 285 of the horizontal waveguide 101 all contribute to the efficiency of EM field coupling through the waveguide-configuration adapter 10. In one implementation of this embodiment, a High Frequency Structure Simulator (HFSS) modeling software is used to optimize the size and shape of the horizontal waveguide 101, the size and shape of the vertical waveguide 102, the dimensions of the first-interface port 118 in the horizontal waveguide 101, the dimensions of the second-interface port 135 in the vertical waveguide 102, the shape of the adaptor matching element 103, and the position of the adaptor matching element 103 on the inner surface of the bottom face 285 of the horizontal waveguide 101 for directing a propagation path of EM waves for: a given frequency; a given polarization; and/or a frequency band.

The waveguide-configuration adapter 10 allows the close spacing of individual radiating elements in antenna arrays since vertical waveguide 102 is within the H-plane width (AH) of the horizontal waveguide 101. The waveguide-configuration adapter 10 is no wider than the horizontal waveguide 101. The waveguide-configuration adapter 10 minimizes the element spacing in an antenna array and reduces (or prevents) grating lobes in the antenna pattern.

FIGS. 1A and 1B show the vertical waveguide 102 centered on (i.e., bisecting the AH dimension along the y axis of the first-coupling port 115) the horizontal waveguide 101. However, in one implementation of this embodiment, the vertical waveguide 102 is not centered on the horizontal waveguide 101. In this latter case, the vertical waveguide 102 is still within the width AH of the horizontal waveguide 101. In another implementation of this embodiment, the vertical waveguide 102 is positioned at the longest side of the horizontal waveguide 101. In this case, the corner labeled x-y-z in the horizontal waveguide 101 shown in 3A is offset by the distance BH in the z direction from the corner labeled x-y-z in the vertical waveguide 102. In this latter embodiment, there is no adaptor matching element 103.

Also, within reason, the cross section of the horizontal waveguide 101 and vertical waveguide 102 can differ. In one implementation of this embodiment, the dimensions AH×BH equal the dimensions AV×BV (FIG. 1A). In another implementation of this embodiment, the dimensions AH×BH differ slightly from the dimensions AV×BV (FIG. 1A).

In one implementation of this embodiment, the surfaces of the horizontal waveguide 101 and the vertical waveguide 102 are formed from metal sheets and the adaptor matching element 103 is formed from metal. In another implementation of this embodiment, the horizontal waveguide 101, the vertical waveguide 102, and the adaptor matching element 103 are formed from stainless steel. In yet another implementation of this embodiment, the horizontal waveguide 101, the vertical waveguide 102, and the adaptor matching element 103 are formed from aluminum. In yet another implementation of this embodiment, the surfaces of the horizontal waveguide 101 and the vertical waveguide 102 are formed from plastic coated with metal.

In yet another implementation of this embodiment, the horizontal waveguide and the vertical waveguide are formed from a solid dielectric material coated with metal material. In this latter embodiment, the horizontal waveguide includes an indented region in the required position for the adaptor matching element 103. The indented region can be coated with metal. In this case, the metal coated indented region is the adaptor matching element 103. In one implementation of this embodiment, an adaptor matching element 103 is inserted into the indented region, which is not metal-coated. In another implementation of this embodiment, an adaptor matching element 103 is inserted into the indented region, which is not metal-coated. The dielectric materials include, but are not limited to: ceramic; nylon; Teflon; acrylonitrile butadiene styrene (ABS); other thermoplastics; or other dielectric materials operable to support EM fields of the desired frequency.

Figure 4:
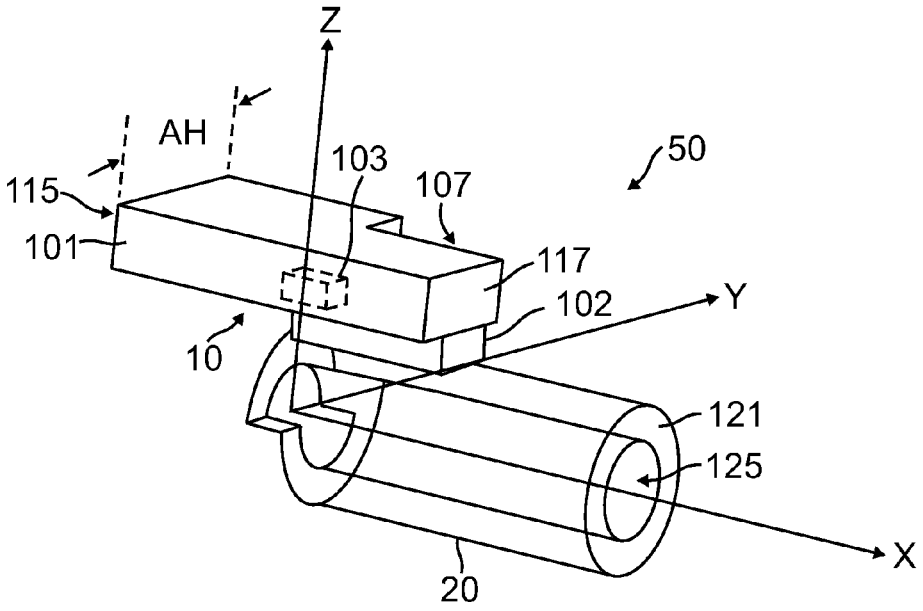
FIG. 4 is an oblique view of one embodiment of a waveguide-configuration adapter providing a side feed for a dual-band-coaxial waveguide.
Figure 5:
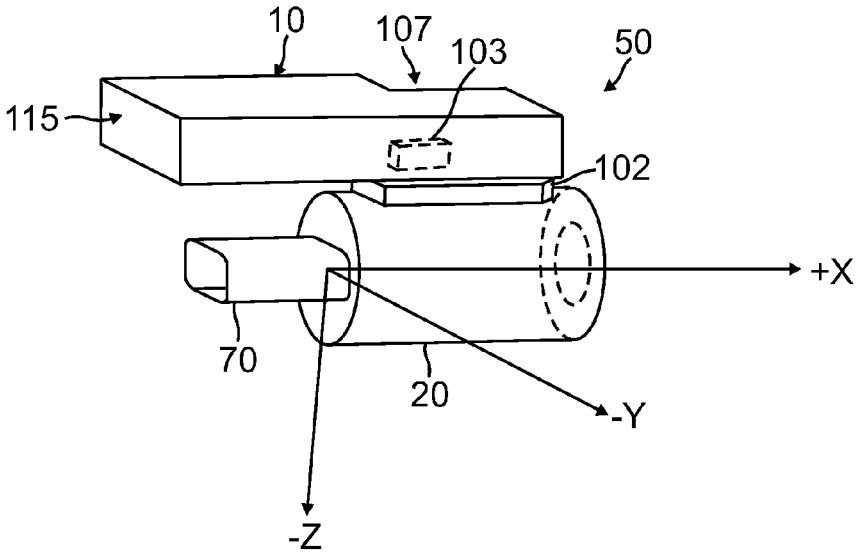
FIG. 5 is an oblique view of the waveguide-configuration adapter providing a side feed for the dual-band-coaxial waveguide of FIG. 4 with a port for a second frequency band or a second polarization.

FIG. 4 is an oblique view of one embodiment of a waveguide-configuration adapter 10 providing a side feed for a dual-band-coaxial waveguide 20. FIG. 5 is an oblique view of the waveguide-configuration adapter 10 providing a side feed for the dual-band-coaxial waveguide 20 of FIG. 4 with a port 70 for a second frequency band or a second polarization. The dual-band-coaxial waveguide 20 includes an annular portion 121 and a hole 125 (also referred to herein as "aperture 125"). The annular portion 121 supports propagation of EM fields in a first frequency band. The hole 125 of the center conductor of the coaxial waveguide 20 is open for the length of the coaxial waveguide 20 and supports propagation of EM fields in a second frequency band. The terms "dual-band-coaxial waveguide 20" and "radiating element 20" are used interchangeably herein.

The waveguide-configuration adapter 10 is configured to side-feed the annular portion 121 of the dual-band-coaxial waveguide 20 while the back-feed hole 125 of the dual-band-coaxial waveguide 20 is simultaneously fed by the center-feed port 70 without the center-feed port 70 and waveguide-configuration adapter 10 mechanically blocking each other. As shown in FIG. 4, the second-coupling port 136 of the vertical waveguide 102 side-feeds the annular portion 121 of the dual-band-coaxial waveguide 20. In another implementation of this embodiment, since the waveguide-configuration adapter 10 is bidirectional in function, the first-coupling port 115 of the horizontal waveguide 101 side-feeds the annular portion 121 of the dual-band-coaxial waveguide 20.

The waveguide-configuration adapter 10 (for a first frequency band or first polarization), the port 70 (for a second frequency band or a second polarization), and the dual-band-coaxial waveguide 20 together form either an element of a dual band antenna or a dual band feed 50 for a dual band antenna.

As shown in FIG. 4, the vertical waveguide 102 has a short vertical-waveguide length $L_{VWG}$ (FIGS. 1A and 3A) extending parallel to the z axis. In one implementation of this embodiment, the vertical waveguide 102 is reduced in vertical-waveguide length $L_{VWG}$ to the minimum-vertical-waveguide length $L_{VWG,min}$ required to couple the side feed EM fields at a first frequency from the horizontal waveguide 101 through the vertical waveguide 102 to the annular portion 121 of the dual-band-coaxial waveguide 20.

In one implementation of this embodiment, the second frequency band of the EM fields coupled to the center of the dual-band-coaxial waveguide 20 is within the range of 20-30 GHz. In another implementation of this embodiment, the second frequency band of the EM fields coupled to the center of the dual-band-coaxial waveguide 20 is within the range of 328 MHz-2.3 GHz. In yet another implementation of this embodiment, the first frequency band of the EM fields coupled to the side of the dual-band-coaxial waveguide 20 is within the range of 30 MHz-144 MHz and the second frequency band of the EM fields coupled to the center of the dual-band-coaxial waveguide 20 is within the range of 328 MHz-2.3 GHz. In yet another implementation of this embodiment, the side feed for the dual-band-coaxial waveguide 20 couples a horizontal E-field and the axial feed of the dual-band-coaxial waveguide 20 couples a vertical E-field.

Figure 6:
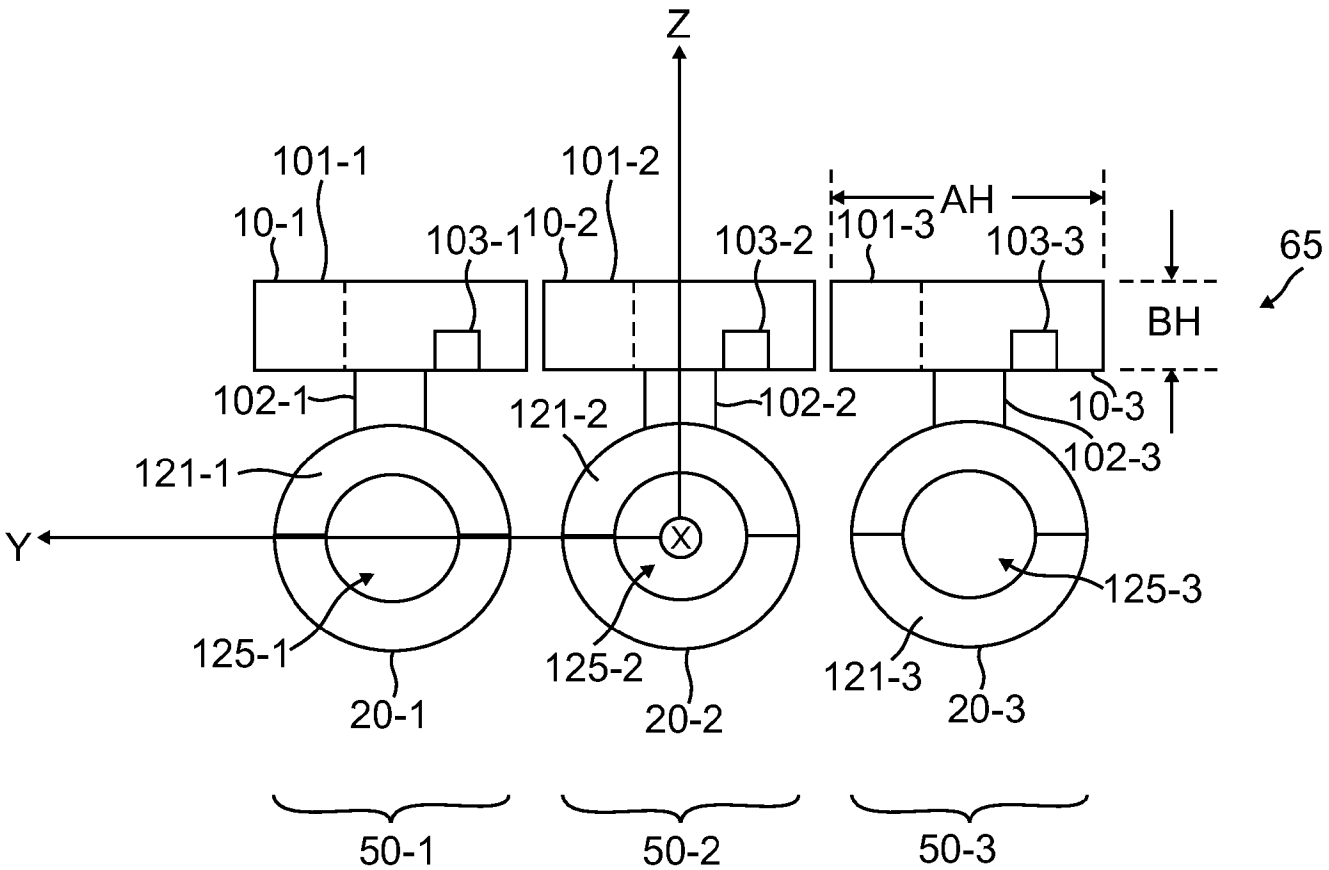
FIG. 6 is a back view of a plurality of waveguide-configuration adapters providing side feeds for a respective plurality of dual-band-coaxial waveguides.

FIG. 6 is a back view of a plurality of waveguide-configuration adapters 10-1, 10-2, and 10-3 providing side feeds for a respective plurality of dual-band-coaxial waveguides 20-1, 20-2, and 20-3. As shown in FIG. 6, the radiating elements 20-1, 20-2, and 20-3 can be spaced as close as the horizontal waveguide width AH, plus some wall thickness. Thus, the waveguide-configuration adapter 10 minimizes the element spacing to suppress the grating lobe of the dual band antenna being feed by (or formed by) the dual-band-coaxial waveguides 20-1, 20-2, and 20-3. This close spacing is also useful in the design of phased arrays and in side lobe reduction. If the radiating elements 20-1, 20-2, and 20-3 are all on at the same time, this configuration is a phased array antenna. If the radiating elements 20-1, 20-2, and 20-3 are turned on at separate times, this configuration is a multi-beam antenna.

The first waveguide-configuration adapter 10-1 for a first frequency band or first polarization, a first port (such as port 70 shown in FIG. 5) for a second frequency band or a second polarization, and the first dual-band-coaxial waveguide 20-1 together form a first dual band feed 50-1 (or a first element) of a dual band antenna.

Similarly, the second waveguide-configuration adapter 10-2 for the first frequency band or the first polarization, a second port (such as port 70 shown in FIG. 5) for the second frequency band or the second polarization, and the second dual-band-coaxial waveguide 20-2 together form a second dual band feed 50-2 (or a second element) of a dual band antenna.

Similarly, the third waveguide-configuration adapter 10-3 for the first frequency band or the first polarization, the third port (such as port 70 shown in FIG. 5) for the second frequency band or the second polarization, and the third dual-band-coaxial waveguide 20-3 together form a third dual band feed 50-3 (or a third element) of a dual band antenna. More than three dual band feeds can be used in an antenna system. In one implementation of this embodiment, a lens is coupled to the output of the dual band antenna 65.

Figure 7:
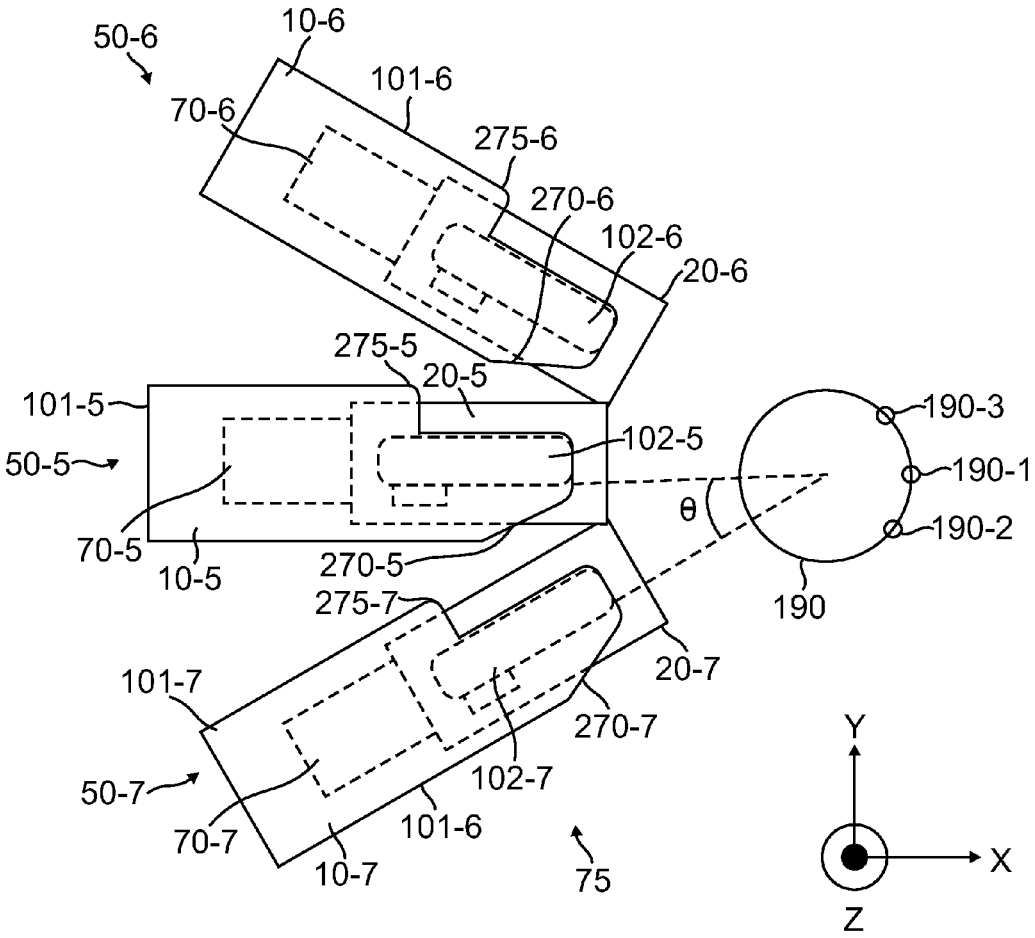
FIG. 7 is a top view of a plurality of closely spaced dual-band feeds.

FIG. 7 is a top view of a plurality of closely spaced dual-band feeds 50-5, 50-6, and 50-7. The closely spaced dual-band feeds 50-5, 50-6, and 50-7 function as a switched beam array 75, a dual band antenna 75, or a feed system 75 to feed to a dual band antenna. In operation as a switched beam array 75, only one radiating element 20-5, 20-6, or 20-7 is energized at a time.

The closely spaced dual-band feeds 50-5, 50-6, and 50-7 include chamfered waveguide-configuration adapters 10-5, 10-6, and 10-7, which function as the waveguide-configuration adapters 10 described above with reference to FIGS. 1A, 1B, 3A-3C, and 4-6. The chamfered waveguide-configuration adapters 10-5, 10-6, and 10-7 included chamfered horizontal waveguides 101-5, 101-6, and 101-7, which function as the horizontal waveguides 101 described above with reference to FIGS. 1A, 1B, 3A-3C, and 4-6. The chamfered horizontal waveguides 101-5, 101-6, and 101-7 have an outer shape of a first rectangular prism conjoined with a second rectangular prism in which at least one of the corners of the first rectangular prism and the second rectangular prism are rounded or beveled.

A coupling lens 190 is arranged at the output end of the dual-band-coaxial waveguides 20-5, 20-6, and 20-7. The poynting angle of the EM wave emitted switched beam array 75 changes as a different radiating element 20-5, 20-6, or 20-7 is selected. These different poynting angles are indicated by the relative position of exemplary exit points 190-1, 190-2, and 190-3 from which the radiation exits from the coupling lens 190.

The first chamfered waveguide-configuration adapter 10-5 for a first frequency band or a first polarization, the first port 70-5 for a second frequency band or a second polarization, and the first dual-band-coaxial waveguide 20-5 together form a first dual band feed 50-5 (or a first element) of a switched beam array 75.

Similarly, the second chamfered waveguide-configuration adapter 10-6 for the first frequency band or the first polarization, the second port 70-6 for the second frequency band or the second polarization, and the second dual-band-coaxial waveguide 20-6 together form a second dual band feed 50-6 (or a second element) of a switched beam array.

Similarly, the third chamfered waveguide-configuration adapter 10-7 for the first frequency band or the first polarization, the third port 70-7 for the second frequency band or the second polarization, and the third dual-band-coaxial waveguide 20-73 together form a third dual band feed 50-7 (or a third element) of a switched beam array. More than three dual band feeds can be used in a switched beam array.

Chamfered waveguide-configuration adapters 10-5, 10-6, and 10-7 provide side feeds for a respective plurality of dual-band-coaxial waveguides 20-5, 20-6, and 20-7. The chamfered horizontal waveguides are 101-5, 101-6, 101-7 are chamfered to permit close angular positioning of each waveguide-configuration adapter to its neighboring waveguide-configuration adapters. By chamfering the horizontal waveguides 101-5, 101-6, 101-7 as shown at respective surfaces 270-5, 270-6, and 270-7, the angular width of the switched beam array 75 is maximized by increasing the number of elements radiating elements 20-1, 20-2, and 20-3, thus thereby increasing the number of beams that fit within a given angular extent.

The chamfered waveguide-configuration adapter 10-5 of dual-band feed 50-5 is chamfered at 270-5 so that dual-band feed 50-7 is able to be positioned at a small angle θ from the neighboring dual-band feed 50-5. Likewise, the chamfered waveguide-configuration adapter 10-7 of dual-band feed 50-7 is chamfered at 275-7 so that dual-band feed 50-5 is able to be positioned at the small angle θ from the neighboring dual-band feed 50-7. When all the waveguide-configuration adapters of dual-band feeds are chamfered in this manner, close angular positioning of the waveguide-configuration adapters to neighboring chamfered waveguide-configuration adapters permits the formation of a tight angular cluster of radiating elements 20-5, 20-6, or 20-7.

In one implementation of this embodiment, the chamfered horizontal waveguide 101-5 and the vertical waveguide 102-5 include radius corners 275 from machining. In another implementation of this embodiment, the switched beam array 75 includes a reflector instead of the lens 195 in front of the dual-band feeds 50-5, 50-6, and 50-7. In yet another implementation of this embodiment, there is no lens 195 or reflector in front of the dual-band feeds 50-5, 50-6, and 50-7.

In one implementation of this embodiment, the adaptors and/or radiating elements are made from machined assembly, possibly with a combination of laser welded covers of the waveguide runs. In another implementation of this embodiment, the adaptors and/or radiating elements are machined in a split block-construction. In yet another implementation of this embodiment, the adaptor and radiating elements are fabricated as an investment casting or a brazed part assembly.

Example Embodiments

Example 1 includes a waveguide-configuration adapter, including a horizontal waveguide including a first-interface port spanning a first X-Y plane and a first-coupling port spanning a Y-Z plane, the first-coupling port having a first-coupling-port width parallel to the y axis; and a vertical waveguide including a second-interface port spanning a second X-Y plane and a second-coupling port spanning a third X-Y plane, the second-coupling port having a second-coupling-port width parallel to the x axis, wherein the second-interface port is juxtaposed to the first-interface port, wherein when an E-field is input at the first-coupling port in the plane of the first-coupling port and oriented perpendicular to the first-coupling-port width, the E-field is output from the second-coupling port in the plane of second-coupling port and oriented perpendicular to the second-coupling-port width, and wherein when an E-field is input at the second-coupling port in the plane of the second-coupling port and oriented perpendicular to the second-coupling-port width, the E-field is output from the first-coupling port in the plane of first-coupling port and oriented perpendicular to the first-coupling-port width.

Example 2 includes the waveguide-configuration adapter of Example 1, further comprising an adaptor matching element positioned in the horizontal waveguide.

Example 3 includes the waveguide-configuration adapter of any of Examples 1-2, wherein the Y-Z plane spanned by the first-coupling port is a first Y-Z plane, wherein the horizontal waveguide further comprises: a first-opposing face in a second Y-Z plane parallel to the first Y-Z plane and offset from the first Y-Z plane by a first length parallel to the x axis; and a second-opposing face in a third Y-Z plane parallel to the first Y-Z plane and offset from the first Y-Z plane by a second length parallel to the x axis.

Example 4 includes the waveguide-configuration adapter of Example 2, wherein the second length is greater than the first length by a third length, and wherein the horizontal waveguide is notched by a notched region having a length of the third length parallel to the x axis, a width of the first-opposing face, and a height of the first-opposing face.

Example 5 includes the waveguide-configuration adapter of any of Examples 3-4, wherein the horizontal waveguide has an outer shape of a first rectangular prism conjoined with a second rectangular prism, the first rectangular prism including the first-opposing face and having a length equal to the first length, the second rectangular prism including the second-opposing face and having a length equal to the second length, wherein the first rectangular prism and the second rectangular prism have open faces that together form the first-coupling port that spans the first Y-Z plane, and wherein the portion of the second rectangular prism that extends beyond the first rectangular prism is adjacent to the notched region.

Example 6 includes the waveguide-configuration adapter of any of Examples 1-5, wherein the second-coupling port of the vertical waveguide that spans the third X-Y plane is offset from the second X-Y plane by a vertical-waveguide length parallel to the z axis.

Example 7 includes the waveguide-configuration adapter of Example 6, wherein the vertical-waveguide length is a minimum length required to couple electro-magnetic fields propagating in the vertical waveguide to a dual-band-coaxial waveguide positioned adjacent to the second-coupling port of the vertical waveguide.

Example 8 includes the waveguide-configuration adapter of any of Examples 1-7, wherein electro-magnetic fields propagating along a first propagation path in the horizontal waveguide are directed to propagate along a second propagation path in the vertical waveguide, wherein, when a dual-band-coaxial waveguide is positioned adjacent to the second-coupling port of the vertical waveguide, the electro-magnetic fields propagating along the second propagation path in the vertical waveguide are coupled to an annular portion of the dual-band-coaxial waveguide.

Example 9 includes the waveguide-configuration adapter of any of Examples 1-8, wherein the horizontal waveguide and the vertical waveguide are formed from one of metal or a dielectric material coated with metal.

Example 10 includes a dual-band feed for at least a portion of a dual band antenna, the dual band feed comprising: a dual-band-coaxial waveguide including: an annular portion for propagating electro-magnetic fields in a first frequency band, and a hole for propagating electro-magnetic fields in a second frequency band; a waveguide-configuration adapter to side-feed the annular portion of the dual-band-coaxial waveguide; and a center-feed port to back-feed the hole of the dual-band-coaxial waveguide, wherein the waveguide-configuration adapter and the center-feed port are configured to simultaneously feed the dual-band-coaxial waveguide.

Example 11 includes the dual-band feed of Example 10, wherein the waveguide-configuration adapter comprises: a horizontal waveguide including a first-interface port spanning a first X-Y plane and a first-coupling port spanning a Y-Z plane, the first-coupling port having a first-coupling-port width parallel to the y axis; and a vertical waveguide including a second-interface port spanning a second X-Y plane and a second-coupling port spanning a third X-Y plane, the second-coupling port having a second-coupling-port width parallel to the x axis, wherein the second-interface port is juxtaposed to the first-interface port, wherein when an E-field is input at the first-coupling port in the plane of the first-coupling port and oriented perpendicular to the first-coupling-port width, the E-field is output from the second-coupling port in the plane of second-coupling port and oriented perpendicular to the second-coupling-port width; and wherein when an E-field is input at the second-coupling port in the plane of the second-coupling port and oriented perpendicular to the second-coupling-port width, the E-field is output from the first-coupling port in the plane of first-coupling port and oriented perpendicular to the first-coupling-port width.

Example 12 includes the dual-band feed of Example 11, wherein the Y-Z plane spanned by the first-coupling port is a first Y-Z plane, wherein the horizontal waveguide further comprises: a first-opposing face in a second Y-Z plane parallel to the first Y-Z plane and offset from the first Y-Z plane by a first length parallel to the x axis; and a second-opposing face in a third Y-Z plane parallel to the first Y-Z plane and offset from the first Y-Z plane by a second length parallel to the x axis.

Example 13 includes the dual-band feed of Example 12, wherein the second length is greater than the first length by a third length, and wherein the horizontal waveguide is notched by a notched region having a length of the third length parallel to the x axis, a width of the first-opposing face, and a height of the first-opposing face.

Example 14 includes the waveguide-configuration adapter of any of Examples 11-13, wherein the second-coupling port of the vertical waveguide that spans the third X-Y plane is offset from the second X-Y plane by a vertical-waveguide length parallel to the z axis.

Example 15 includes the waveguide-configuration adapter of any of Examples 11-14, wherein electro-magnetic radiation propagating along a first propagation path in the horizontal waveguide is bent to propagate along a second propagation path in the vertical waveguide, wherein, the electro-magnetic radiation propagating along the second propagation path in the vertical waveguide is coupled to the annular portion of the dual-band-coaxial waveguide.

Example 16 includes a switched beam array comprising: dual-band feeds for at least a portion of a dual band antenna, at least one of the dual-band feeds comprising: a dual-band-coaxial waveguide including: an annular portion for propagating electro-magnetic fields in a first frequency band, and a hole for propagating electro-magnetic fields in a second frequency band; a chamfered waveguide-configuration adapter to side-feed the annular portion of the dual-band-coaxial waveguide; and a center-feed port to back-feed the hole of the dual-band-coaxial waveguide, wherein the chamfered waveguide-configuration adapter and the center-feed port are configured to simultaneously feed the dual-band-coaxial waveguide, and wherein the chamfered waveguide-configuration adapter permits close angular positioning of the chamfered waveguide-configuration adapter to its neighboring waveguide-configuration adapters.

Example 17 includes the switched beam array of Example 16, wherein the at least one chamfered waveguide-configuration adapter of the dual-band feeds comprise: a chamfered horizontal waveguide including a first-interface port spanning a first X-Y plane, and a first-coupling port spanning a Y-Z plane, the first-coupling port having a first-coupling-port width parallel to the y axis; a vertical waveguide including a second-interface port spanning a second X-Y plane, and a second-coupling port spanning a third X-Y plane, the second-coupling port having a second-coupling-port width parallel to the x axis, wherein the second-interface port is juxtaposed to the first-interface port, wherein when an E-field is input at the first-coupling port in the plane of the first-coupling port and oriented perpendicular to the first-coupling-port width, the E-field is output from the second-coupling port in the plane of second-coupling port and oriented perpendicular to the second-coupling-port width; and wherein when an E-field is input at the second-coupling port in the plane of the second-coupling port and oriented perpendicular to the second-coupling-port width, the E-field is output from the first-coupling port in the plane of first-coupling port and oriented perpendicular to the first-coupling-port width.

Example 18 includes the switched beam array of Example 17, wherein the Y-Z plane spanned by the first-coupling port is a first Y-Z plane, wherein the chamfered horizontal waveguide further comprises: a first-opposing face in a second Y-Z plane parallel to the first Y-Z plane and offset from the first Y-Z plane by a first length parallel to the x axis; and a second-opposing face in a third Y-Z plane parallel to the first Y-Z plane and offset from the first Y-Z plane by a second length parallel to the x axis.

Example 19 includes the switched beam array of Example 18, wherein the second length is greater than the first length by a third length, and wherein the chamfered horizontal waveguide is notched by a notched region having a length of the third length parallel to the x axis, a width of the first-opposing face, and a height of the first-opposing face.

Example 20 includes the switched beam array any of Examples 17-19, wherein the vertical-waveguide length is a minimum length required to couple electro-magnetic fields propagating in the vertical waveguide to the annular portion of the dual-band-coaxial waveguide positioned adjacent to the second-coupling port of the vertical waveguide.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A waveguide-configuration adapter, comprising:

a horizontal waveguide including a first-interface port spanning a first X-Y plane and a first-coupling port spanning a Y-Z plane, the first-coupling port having a first-coupling-port width parallel to the y axis; and a vertical waveguide including a second-interface port spanning a second X-Y plane and a second-coupling port spanning a third X-Y plane, the second-coupling port having a second-coupling-port width parallel to the x axis, wherein the second-interface port is juxtaposed to the first-interface port;

wherein when an E-field is input at the first-coupling port in the plane of the first-coupling port and oriented perpendicular to the first-coupling-port width, the E-field is output from the second-coupling port in the plane of second-coupling port and oriented perpendicular to the second-coupling-port width, and wherein when an E-field is input at the second-coupling port in the plane of the second-coupling port and oriented perpendicular to the second-coupling-port width, the E-field is output from the first-coupling port in the plane of first-coupling port and oriented perpendicular to the first-coupling-port width, wherein electro-magnetic fields propagating along a first propagation path in the horizontal waveguide are directed to propagate along a second propagation path in the vertical waveguide, wherein, when a dual-band-coaxial waveguide is positioned adjacent to the second-coupling port of the vertical waveguide, the electro-magnetic fields propagating along the second propagation path in the vertical waveguide are coupled to an annular portion of the dual-band-coaxial waveguide.

2. The waveguide-configuration adapter of claim 1, further comprising an adaptor matching element positioned in the horizontal waveguide.

3. The waveguide-configuration adapter of claim 1, wherein the Y-Z plane spanned by the first-coupling port is a first Y-Z plane, wherein the horizontal waveguide further comprises:

a first-opposing face in a second Y-Z plane parallel to the first Y-Z plane and offset from the first Y-Z plane by a first length parallel to the x axis; and a second-opposing face in a third Y-Z plane parallel to the first Y-Z plane and offset from the first Y-Z plane by a second length parallel to the x axis.

4. The waveguide-configuration adapter of claim 3, wherein the second length is greater than the first length by a third length, and wherein the horizontal waveguide is notched by a notched region having a length of the third length parallel to the x axis, a width of the first-opposing face, and a height of the first-opposing face.

5. The waveguide-configuration adapter of claim 3, wherein the horizontal waveguide has an outer shape of a first rectangular prism conjoined with a second rectangular prism, the first rectangular prism including the first-opposing face and having a length equal to the first length, the second rectangular prism including the second-opposing face and having a length equal to the second length, wherein the first rectangular prism and the second rectangular prism have open faces that together form the first-coupling port that spans the first Y-Z plane, and wherein the portion of the second rectangular prism that extends beyond the first rectangular prism is adjacent to the notched region.

6. The waveguide-configuration adapter of claim 1, wherein the second-coupling port of the vertical waveguide that spans the third X-Y plane is offset from the second X-Y plane by a vertical-waveguide length parallel to the z axis.

7. The waveguide-configuration adapter of claim 6, wherein the vertical-waveguide length is a minimum length required to couple electro-magnetic fields propagating in the vertical waveguide to a dual-band-coaxial waveguide positioned adjacent to the second-coupling port of the vertical waveguide.

8. The waveguide-configuration adapter of claim 1, wherein the horizontal waveguide and the vertical waveguide are formed from one of metal or a dielectric material coated with metal.

9. A dual-band feed for at least a portion of a dual band antenna, the dual band feed comprising:

a dual-band-coaxial waveguide including:

an annular portion for propagating electro-magnetic fields in a first frequency band, and a hole for propagating electro-magnetic fields in a second frequency band;

a waveguide-configuration adapter to side-feed the annular portion of the dual-band-coaxial waveguide; and a center-feed port to back-feed the hole of the dual-band-coaxial waveguide, wherein the waveguide-configuration adapter and the center-feed port are configured to simultaneously feed the dual-band-coaxial waveguide.

10. The dual-band feed of claim 9, wherein the waveguide-configuration adapter comprises:

a horizontal waveguide including a first-interface port spanning a first X-Y plane and a first-coupling port spanning a Y-Z plane, the first-coupling port having a first-coupling-port width parallel to the y axis; and a vertical waveguide including a second-interface port spanning a second X-Y plane and a second-coupling port spanning a third X-Y plane, the second-coupling port having a second-coupling-port width parallel to the x axis, wherein the second-interface port is juxtaposed to the first-interface port, wherein when an E-field is input at the first-coupling port in the plane of the first-coupling port and oriented perpendicular to the first-coupling-port width, the E-field is output from the second-coupling port in the plane of second-coupling port and oriented perpendicular to the second-coupling-port width; and wherein when an E-field is input at the second-coupling port in the plane of the second-coupling port and oriented perpendicular to the second-coupling-port width, the E-field is output from the first-coupling port in the plane of first-coupling port and oriented perpendicular to the first-coupling-port width.

11. The dual-band feed of claim 10, wherein the Y-Z plane spanned by the first-coupling port is a first Y-Z plane, wherein the horizontal waveguide further comprises:

a first-opposing face in a second Y-Z plane parallel to the first Y-Z plane and offset from the first Y-Z plane by a first length parallel to the x axis; and a second-opposing face in a third Y-Z plane parallel to the first Y-Z plane and offset from the first Y-Z plane by a second length parallel to the x axis.

12. The dual-band feed of claim 11, wherein the second length is greater than the first length by a third length, and wherein the horizontal waveguide is notched by a notched region having a length of the third length parallel to the x axis, a width of the first-opposing face, and a height of the first-opposing face.

13. The dual-band feed of claim 10, wherein the second-coupling port of the vertical waveguide that spans the third X-Y plane is offset from the second X-Y plane by a vertical-waveguide length parallel to the z axis.

14. The dual-band feed of claim 10, wherein electro-magnetic radiation propagating along a first propagation path in the horizontal waveguide is bent to propagate along a second propagation path in the vertical waveguide, wherein, the electro-magnetic radiation propagating along the second propagation path in the vertical waveguide is coupled to the annular portion of the dual-band-coaxial waveguide.

15. A switched beam array comprising:

dual-band feeds for at least a portion of a dual band antenna, at least one of the dual-band feeds comprising:

a dual-band-coaxial waveguide including:

an annular portion for propagating electro-magnetic fields in a first frequency band, and a hole for propagating electro-magnetic fields in a second frequency band;

a chamfered waveguide-configuration adapter to side-feed the annular portion of the dual-band-coaxial waveguide; and a center-feed port to back-feed the hole of the dual-band-coaxial waveguide, wherein the chamfered waveguide-configuration adapter and the center-feed port are configured to simultaneously feed the dual-band-coaxial waveguide, and wherein the chamfered waveguide-configuration adapter permits close angular positioning of the chamfered waveguide-configuration adapter to its neighboring waveguide-configuration adapters.

16. The switched beam array of claim 15, wherein the at least one chamfered waveguide-configuration adapter of the dual-band feeds comprise:

a chamfered horizontal waveguide including a first-interface port spanning a first X-Y plane, and a first-coupling port spanning a Y-Z plane, the first-coupling port having a first-coupling-port width parallel to the y axis; and a vertical waveguide including a second-interface port spanning a second X-Y plane, and a second-coupling port spanning a third X-Y plane, the second-coupling port having a second-coupling-port width parallel to the x axis, wherein the second-interface port is juxtaposed to the first-interface port;

wherein when an E-field is input at the first-coupling port in the plane of the first-coupling port and oriented perpendicular to the first-coupling-port width, the E-field is output from the second-coupling port in the plane of second-coupling port and oriented perpendicular to the second-coupling-port width; and wherein when an E-field is input at the second-coupling port in the plane of the second-coupling port and oriented perpendicular to the second-coupling-port width, the E-field is output from the first-coupling port in the plane of first-coupling port and oriented perpendicular to the first-coupling-port width.

17. The switched beam array of claim 16, wherein the Y-Z plane spanned by the first-coupling port is a first Y-Z plane, wherein the chamfered horizontal waveguide further comprises:

a first-opposing face in a second Y-Z plane parallel to the first Y-Z plane and offset from the first Y-Z plane by a first length parallel to the x axis; and a second-opposing face in a third Y-Z plane parallel to the first Y-Z plane and offset from the first Y-Z plane by a second length parallel to the x axis.

18. The switched beam array of claim 17, wherein the second length is greater than the first length by a third length, and wherein the chamfered horizontal waveguide is notched by a notched region having a length of the third length parallel to the x axis, a width of the first-opposing face, and a height of the first-opposing face.

19. The switched beam array of claim 16, wherein the vertical-waveguide length is a minimum length required to couple electro-magnetic fields propagating in the vertical waveguide to the annular portion of the dual-band-coaxial waveguide positioned adjacent to the second-coupling port of the vertical waveguide.

* * * * *